US008832982B1

(12) United States Patent
Bacskai et al.

(10) Patent No.: US 8,832,982 B1
(45) Date of Patent: Sep. 16, 2014

(54) RETAIL WALL PANEL SYSTEM

(71) Applicant: Target Brands, Inc., Minneapolis, MN (US)

(72) Inventors: Amy M. Bacskai, St. Paul, MN (US); Robert G. Logan, Blaine, MN (US); Daniel Golke, Minneapolis, MN (US); David Cheney, St. Paul, MN (US); Jason L. Dusbabek, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/905,451

(22) Filed: May 30, 2013

(51) Int. Cl.

| | |
|---|---|
| ***G09F 7/00*** | (2006.01) |
| ***G09F 15/00*** | (2006.01) |
| ***A47F 5/00*** | (2006.01) |
| *G09F 7/10* | (2006.01) |

(52) U.S. Cl.
CPC ..... *G09F 15/0006* (2013.01); *A47F 5/00* (2013.01); *G09F 15/0012* (2013.01); *G09F 7/10* (2013.01)
USPC ..... 40/611.06; 40/657

(58) Field of Classification Search
USPC ..... 40/611.06, 657; 211/94.01, 94.02, 211/85.26
See application file for complete search history.

(56) References Cited

U.S. PATENT DOCUMENTS

| | | | | |
|---|---|---|---|---|
| 2,769,553 | A | | 11/1956 | Horton |
| 2,901,849 | A | | 9/1959 | Callison |
| 3,208,170 | A | | 9/1965 | Madey |
| 3,429,546 | A | | 2/1969 | Porter |
| 3,516,552 | A | | 6/1970 | Salava |
| 3,608,741 | A | | 9/1971 | Schray |
| 4,190,167 | A | | 2/1980 | Wells et al. |
| 4,292,752 | A | * | 10/1981 | Clark ..... 40/576 |
| 4,344,244 | A | | 8/1982 | Tyke |
| 4,798,013 | A | | 1/1989 | Sainato |
| 4,960,258 | A | | 10/1990 | Stocker et al. |
| 5,241,767 | A | | 9/1993 | Fuda et al. |
| 5,437,116 | A | | 8/1995 | Hardy |
| 5,664,749 | A | | 9/1997 | Kump et al. |
| 5,930,926 | A | | 8/1999 | Kaplan |
| 5,975,318 | A | | 11/1999 | Jay |
| 6,015,124 | A | | 1/2000 | Loy |
| 6,092,320 | A | | 7/2000 | Bringuet |

(Continued)

OTHER PUBLICATIONS

U.S. Appl. No. 13/860,386, filed Apr. 10, 2013 (78 pages).

(Continued)

*Primary Examiner* — Kristina Junge
(74) *Attorney, Agent, or Firm* — Griffiths & Seaton PLLC; JoAnn M. Seaton

(57) ABSTRACT

A wall panel system includes first and second support members, mounting brackets, a backer board, and a graphic panel. The first support member includes a first substantially planar panel and a first reception cavity. The second support member includes a second substantially planar panel and a second reception cavity. The mounting brackets are configured to each be selectively coupled with the retail display. A first mounting bracket couples the first support member to the retail display, and a second mounting bracket couples the second support member to the retail display. A rear surface of the graphic panel faces a front surface of the backer board. Top edges of the backer board and the graphic panel are each slidably received in the first reception cavity. Bottom edge of the backer board and the graphic panel are each slidably received in the second reception cavity of the second support member.

24 Claims, 13 Drawing Sheets

(56) References Cited

U.S. PATENT DOCUMENTS

| | | | | |
|---|---|---|---|---|
| 6,349,507 | B1 | 2/2002 | Muellerleile | |
| 6,578,302 | B1 | 6/2003 | Benaquista et al. | |
| 6,601,328 | B1 * | 8/2003 | Benaquista et al. | 40/611.06 |
| 6,945,414 | B1 | 9/2005 | Stevens et al. | |
| 6,976,331 | B2 | 12/2005 | Fast | |
| 7,717,279 | B2 | 5/2010 | Lawson | |
| 7,798,338 | B2 | 9/2010 | Maheu et al. | |
| D634,861 | S | 3/2011 | Whittier et al. | |
| 8,191,295 | B2 | 6/2012 | Junkins et al. | |
| 2005/0016039 | A1 | 1/2005 | Abramson | |
| 2006/0213850 | A1 * | 9/2006 | VanCalbergh et al. | 211/94.01 |
| 2006/0213851 | A1 * | 9/2006 | Grueneberg | 211/128.1 |
| 2008/0099417 | A1 * | 5/2008 | Zandt | 211/57.1 |
| 2008/0116159 | A1 | 5/2008 | Chu | |
| 2008/0172917 | A1 | 7/2008 | Brandow et al. | |
| 2009/0056185 | A1 | 3/2009 | Wamsley | |
| 2011/0219653 | A1 | 9/2011 | Shea et al. | |
| 2012/0144708 | A1 * | 6/2012 | Schwartz | 40/611.01 |
| 2013/0263486 | A1 * | 10/2013 | Logan et al. | 40/607.13 |

OTHER PUBLICATIONS

U.S. Appl. No. 29/417,866, filed Apr. 10, 2012 (20 pages).

Photograph of Sign Used in Target Stores, Admitted Prior Art (1 page).

* cited by examiner

RETAIL WALL PANEL SYSTEM

BACKGROUND OF THE INVENTION

Retail businesses typically use a wide variety of systems to display products and related information to consumers. In order to draw attention to the products displayed and/or to assist the consumer in locating the particular product for which they are searching, additional signs or other indicating means are becoming increasingly important. Such signs are typically mounted to the display systems to indicate the type of product, brand of product, advertising, sale status indicator, department, or other information that relates to the displayed products and is generally helpful to the consumer. The above-described signs are generally positioned to correspond with particular products placed upon shelves, pegs, or other display devices. Preferably, such signs are securely mounted to the shelf or display system, are effective in communicating the indicated information such as the product type, brand name, logo, etc., to the consumer, and are aesthetically pleasing to consumers so as not to distract from the product display itself.

SUMMARY OF THE INVENTION

One aspect of the present invention relates to a wall panel system for coupling to a retail display. The wall panel system includes a first support member, a second support member, a plurality of mounting brackets, a backer board, and a graphic panel. The first support member includes a first substantially planar panel and a first reception cavity extending along a top edge and a front face of the first substantially planar panel. The second support member is formed separately from the first support member and includes a second substantially planar panel and a second reception cavity extending along a bottom edge of a front face of the second substantially planar panel. The plurality of mounting brackets are configured to each be selectively coupled with the retail display. At least a first mounting bracket of the plurality of mounting brackets couples the first support member to the retail display, and at least a second mounting bracket of the plurality of mounting brackets couples the second support member to the retail display below the first support member. The backer board defines a front surface, a top edge, and a bottom edge, the backer board being substantially planar. The graphic panel defines a rear surface, a top edge, and a bottom edge. The rear surface of the graphic panel faces the front surface of the backer board. The top edge of the backer board and the top edge of the graphic panel are each slidably received in the first reception cavity of the first support member. The bottom edge of the backer board and the bottom edge of the graphic panel are each slidably received in the second reception cavity of the second support member. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

The present invention provides a wall panel system for use with a retail display. In particular, a customizable wall panel system configured to be selectively and adjustably coupled to the retail display. The wall panel system presents a first substantially planar panel and/or a second substantially planar panel each having a substantially vertical orientation and extending in front of walls or display fixtures of the retail display. In one embodiment, the first and second substantially planar panels are presented one in front of the other providing a three-dimensional display. Support members and corresponding brackets are utilized to hang the first substantially planar panel from the retail display at a desired position from one or more vertical supports. The resultant wall panel system is customizable and utilizes largely recyclable and reusable components.

Figure 1:
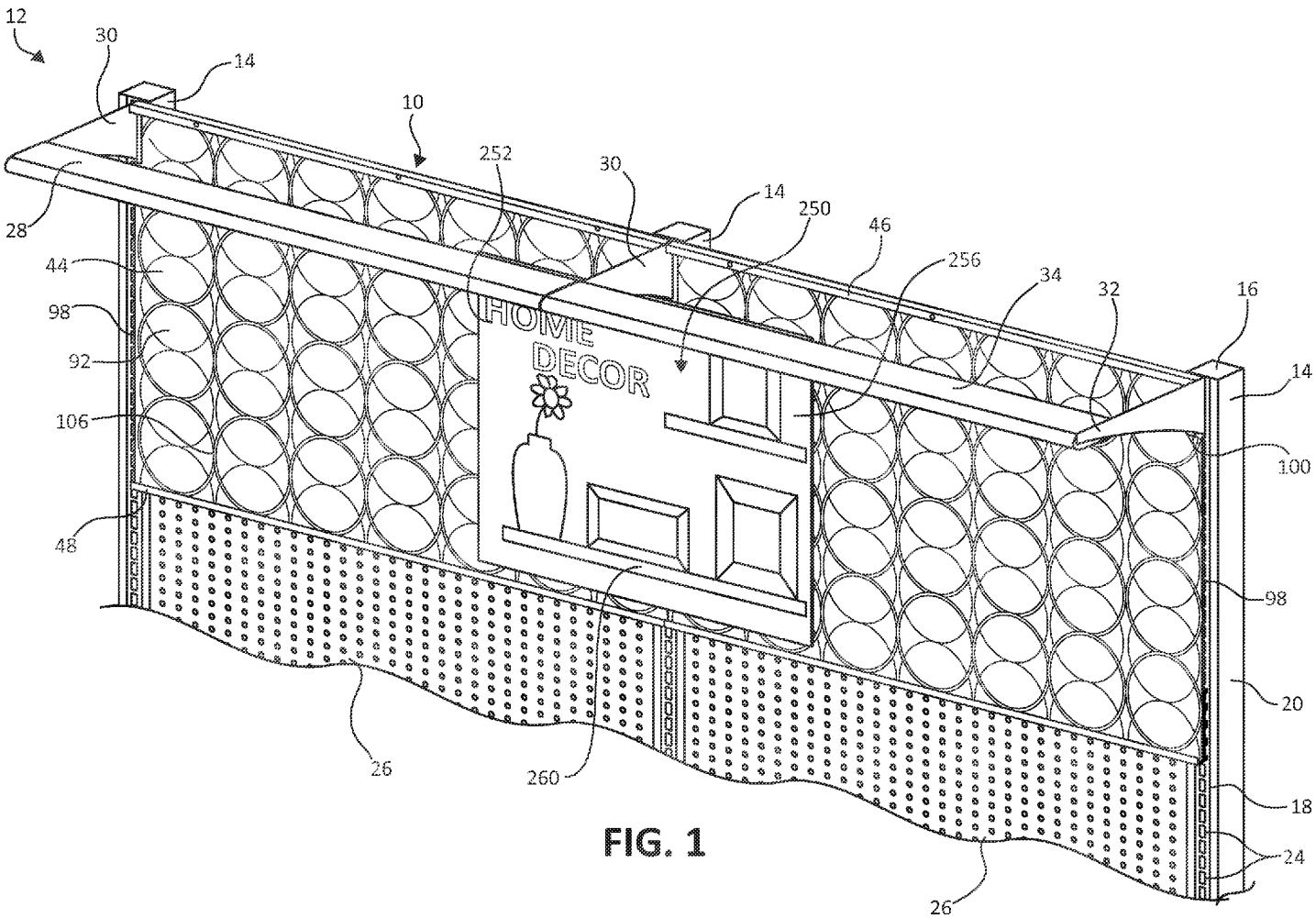
FIG. 1 is a front perspective view illustration of a retail display and a wall panel system, according to one embodiment of the present invention.

Referring to the figures, FIG. 1 illustrates a front perspective view of a wall panel system 10 and a retail display 12. Retail display 12 includes elongated supports 14, e.g., substantially vertically extending supports, transversely spaced from one another and intervening panels or display walls 26 transversely extending substantially vertically therebetween. Each elongated support 14 includes a top end 16, a front surface 18, and side surfaces 20 each extending rearwardly from opposing sides of the front surface 18. The front surface 18 includes a linear array of reception slots 24 or engagement features extending, for example, in a vertical column. In one embodiment, a light assembly 28 transversely extends outwardly in front of display walls 26 and is supported by offset brackets 30 extending from front surfaces 18 of elongated supports 14. More specifically, in the illustrated example, a laterally extending lighting housing 34 extends from front ends 32 of offset brackets 30 and maintain lights (not shown) and facilitates direction of illumination from such lights toward display walls 26. In one example, each of offset brackets is coupled with a corresponding one of elongated supports 14 near top end 16 of the corresponding one of elongated slots 14 via one or more of the slots of the linear array of reception slots 24.

Figure 7:
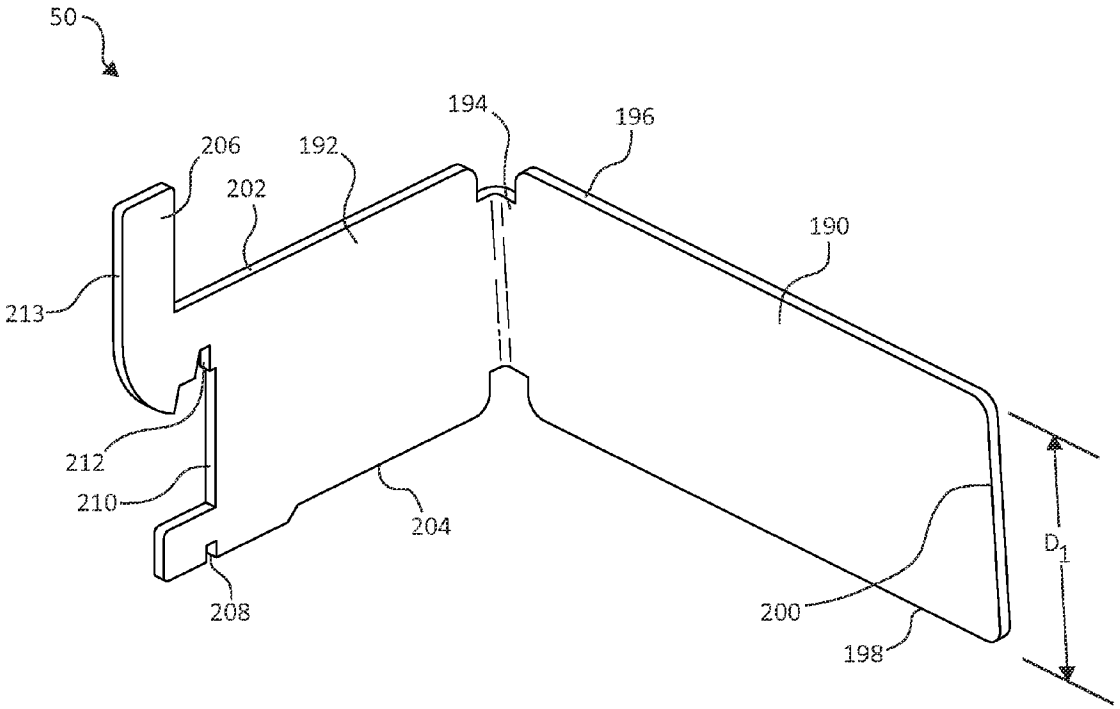
FIG. 7 is a rear perspective view illustration of a mounting bracket that can be used as part of the wall panel system of FIG. 2, according to one embodiment of the present invention.
Figure 8:
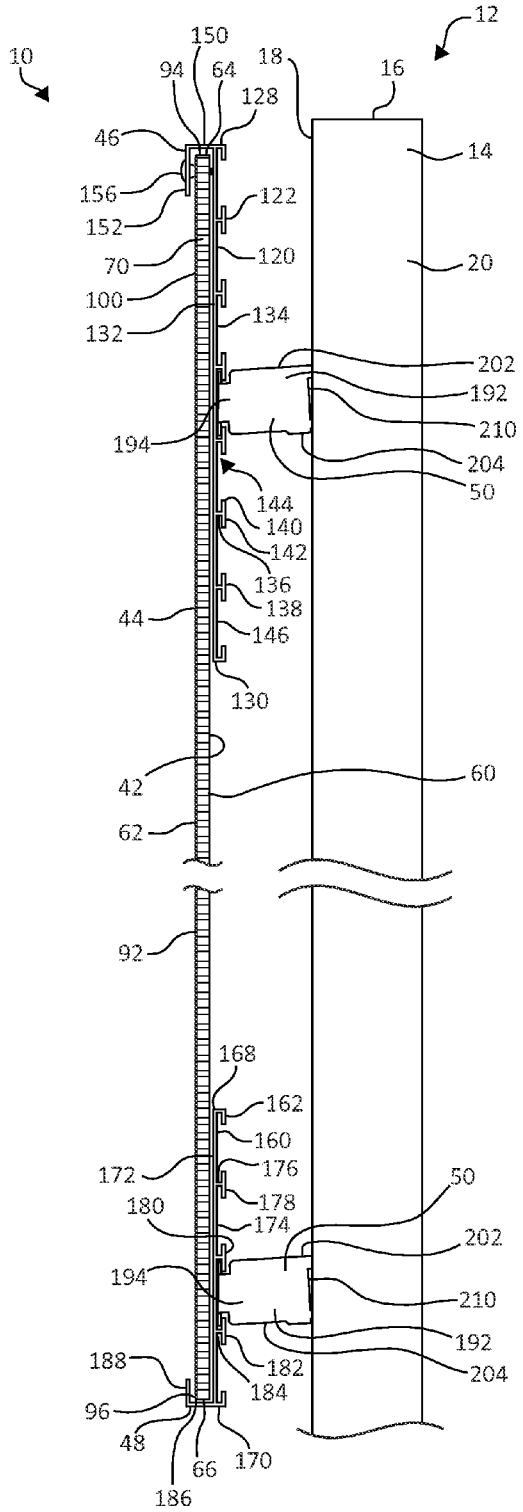
FIG. 8 is partial side view illustration of the retail display and the wall panel system of FIG. 1, according to one embodiment of the present invention.

Architectural or wall panel system 10 is used in combination with retail display 12, for example, as described above and pictured in FIG. 1, although use with other retail displays or similar structures is also contemplated and will be apparent to those of skill in the art upon reading the present application. Additionally referring to FIGS. 2 and 3, in one embodiment, wall panel system 10 includes a backer board 42, a graphic panel 44, a first support member 46, a second support member 48, and mounting brackets 50 (FIGS. 7 and 8). Backer board 42 and graphic panel 44 are slid into engagement with each of first support member 46 and second support member 48 such that backer board 42 and the corresponding graphic panel 44 coextend from first support member 46 to second support member 48. Each of first support member 46 and second support member 48 selectively couples with one or more of mounting brackets 50, which, in turn, selectively couple to elongated supports 14 via the linear array of reception slots 24 as will be further described below. Products offered for sale and support components (not shown) are typically placed below wall panel system 10, e.g., products supported by support components hung from elongated supports 14 and/or display walls 26.

Figure 2:
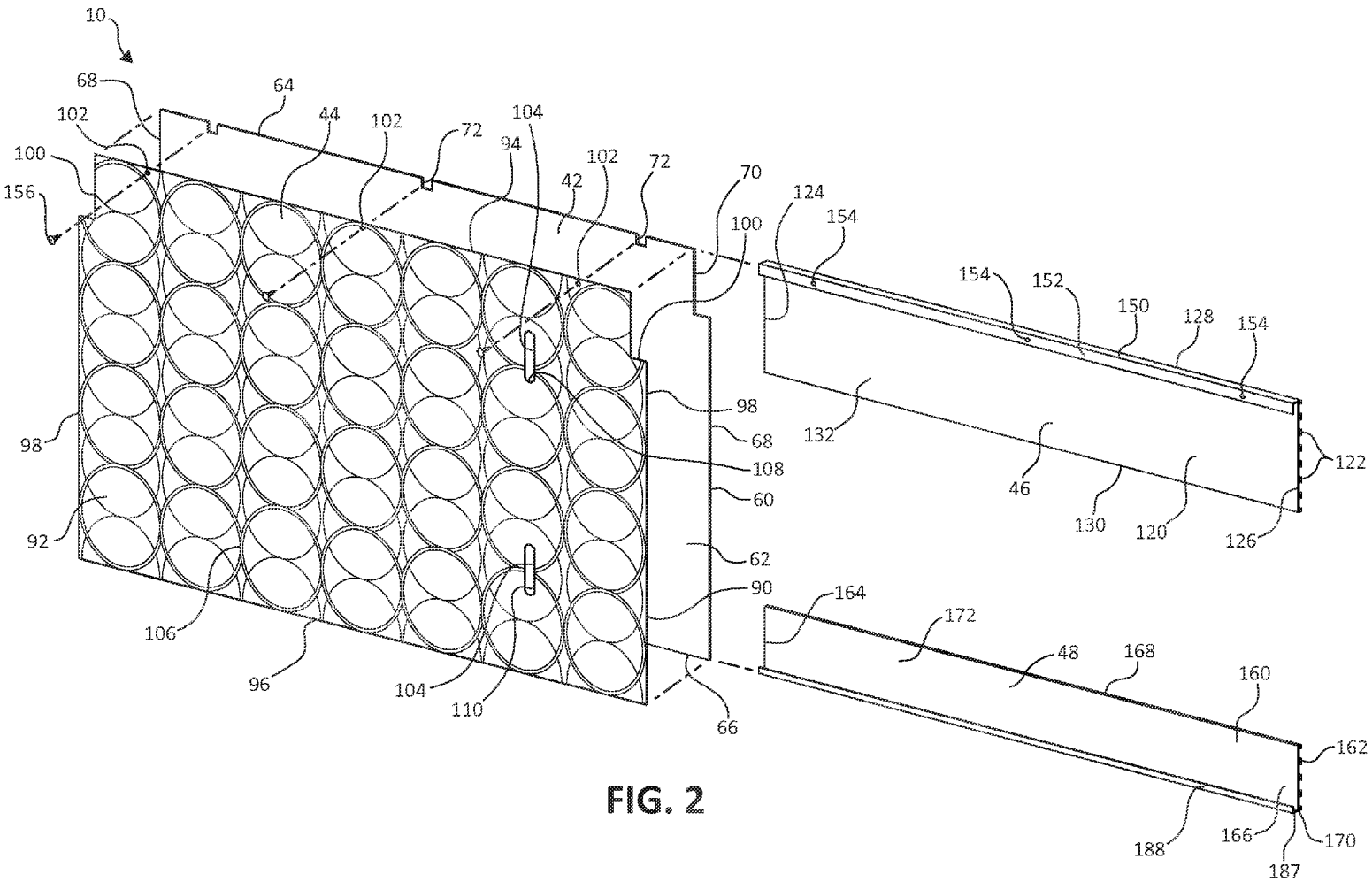
FIG. 2 is an exploded, front perspective view illustration of a portion of a wall panel system, according to one embodiment of the present invention.
Figure 3:
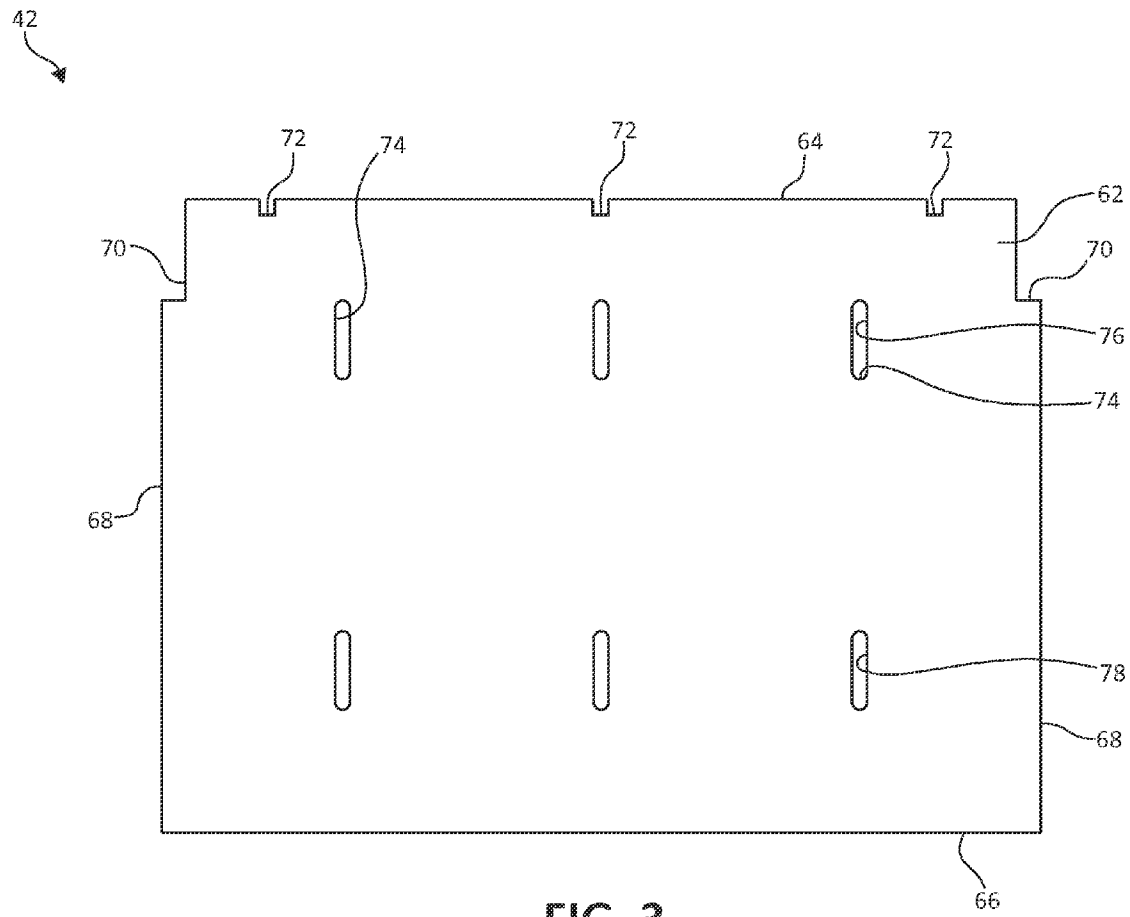
FIG. 3 is a front view of a backer board of the wall panel system of FIG. 2, according to one embodiment of the present invention.

Wall panel system 10 is more particularly illustrated in the exploded perspective view of FIG. 2. Backer board 42, also illustrated in FIG. 3, is cut from paper based display board, for example, the display board known as Falconboard® graphic display board sold by Hexacomb Corporation of Buffalo Grove, Ill., corrugated cardboard, or other suitable board providing rigidity, three dimensional stability, and structural integrity allowing for repeated reuse while still providing for an environmentally responsible disposal, e.g., substantial or complete recyclability. Backer board 42 defines a first substantially planar or back surface 60 and a second substantially planar or front surface 62 opposite back surface 60. Backer board 42 further defines a top edge 64, a bottom edge 66 opposite top edge 64, and opposite side edges 68 each extending between top edge 64 and bottom edge 66. In one example, each of back surface 60 and front surface 62 are the major or primary surfaces of backer board 42 with top edge 64, bottom edge 66, and opposite side edges 68 each having substantially negligible dimensions in comparison.

In one embodiment, each of back surface 60 and front surface 62 is substantially rectangular in shape and/or at least front surface 62 is white or otherwise coated so as not to interfere with the visual presentation of wall panel system 10. In one example, cutouts 70 are formed at each top corner of backer board 42 extending downwardly from top edge 64 and inwardly from each opposing side edge 68 toward the other opposing side edge 68. Backer board 42 optionally additionally or alternatively includes downwardly extending notches 72 from top edge 64 transversely spaced from one another. Backer board 42 defines interior apertures or interior slots 74 spaced from each of top edge 64, bottom edge 66, and opposing side edges 68 of backer board 42. Each of interior slots 74 is substantially elongated and vertically extending, and in one example, interior slots 74 are arranged in a multiple row array, such as the two-row array illustrated in FIG. 3 including a top row 76 and a bottom row 78 of interior slots 74. The number of columns for slots in the array of interior slots 74 may vary, and in one embodiment, is three or more or another suitable number extending largely across a substantial entirety of a width of backer board 42.

Figure 4:
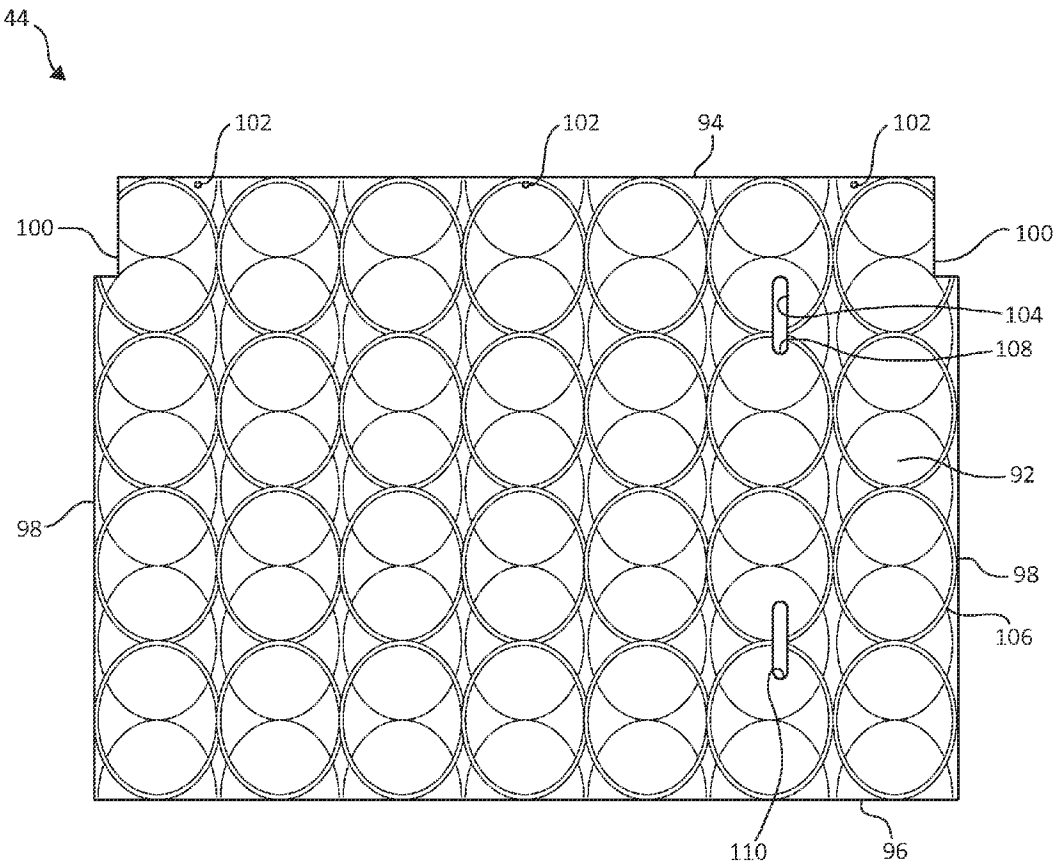
FIG. 4 is a front view of a graphic panel of the wall panel system of FIG. 2, according to one embodiment of the present invention.

Graphic panel 44, described with reference to FIGS. 1, 2, and 4, is cut from paper or similar thin planar member configured to be readily printed, replaced, and disposed of in an environmentally responsible manner, e.g., substantial or complete recyclability. Graphic panel 44 defines a first substantially planar or back surface 90 and a second substantially planar or front surface 92 opposite back surface 90. Graphic panel 44 further defines a top edge 94, a bottom edge 96 opposite top edge 94, and opposite side edges 98 each extending between top edge 94 and bottom edge 96. In one example, each of back surface 90 and front surface 92 are the major or primary surfaces of graphic panel 44 with top edge 94, bottom edge 96, and opposite side edges 98 each having substantially negligible dimensions in comparison.

In one embodiment, each of back surface 90 and front surface 92 is substantially rectangular in shape and graphic panel 44 has a sufficient thickness to provide an opaque panel generally preventing see-through to features on a rear side thereof. Front surface 92 is printed with or otherwise includes graphics 106 including textural indicia and/or other graphic elements desired to identify a department, product types, specific products, prices, sales, etc. for the retail setting where it will be used. In one example, cutouts 100 are formed at each top corner of graphic panel 44 extending downwardly from top edge 94 and inwardly from each opposing side edge 98 toward the other opposing side edge 98. Graphic panel 44 optionally additionally or alternatively includes apertures 102 spaced just below top edge 94 and transversely spaced from one another. Graphic panel 44 defines interior apertures or interior slots 104 spaced from each of top edge 94, bottom edge 96, and opposing side edges 98. Each of interior slots 104 is substantially elongated and vertically extending, and in one example, interior slots 104 are arranged in a multiple row array, such as the two-row array illustrated in FIG. 4 including a top row 108 and a bottom row 110 of interior slots 74. The number of columns for slots in the array of interior slots 74 may vary, and in one embodiment, is three or more or another suitable number extending largely across a substantial entirety of a width of graphic panel 44. In one embodiment, interior slots 104 are sized substantially identically to interior slots 74 of backer board, are equal to or smaller in number than interior slots 74, and/or are positioned to align with interior slots 74 upon assembly of wall panel system 10, as will be further described below.

Figure 5:
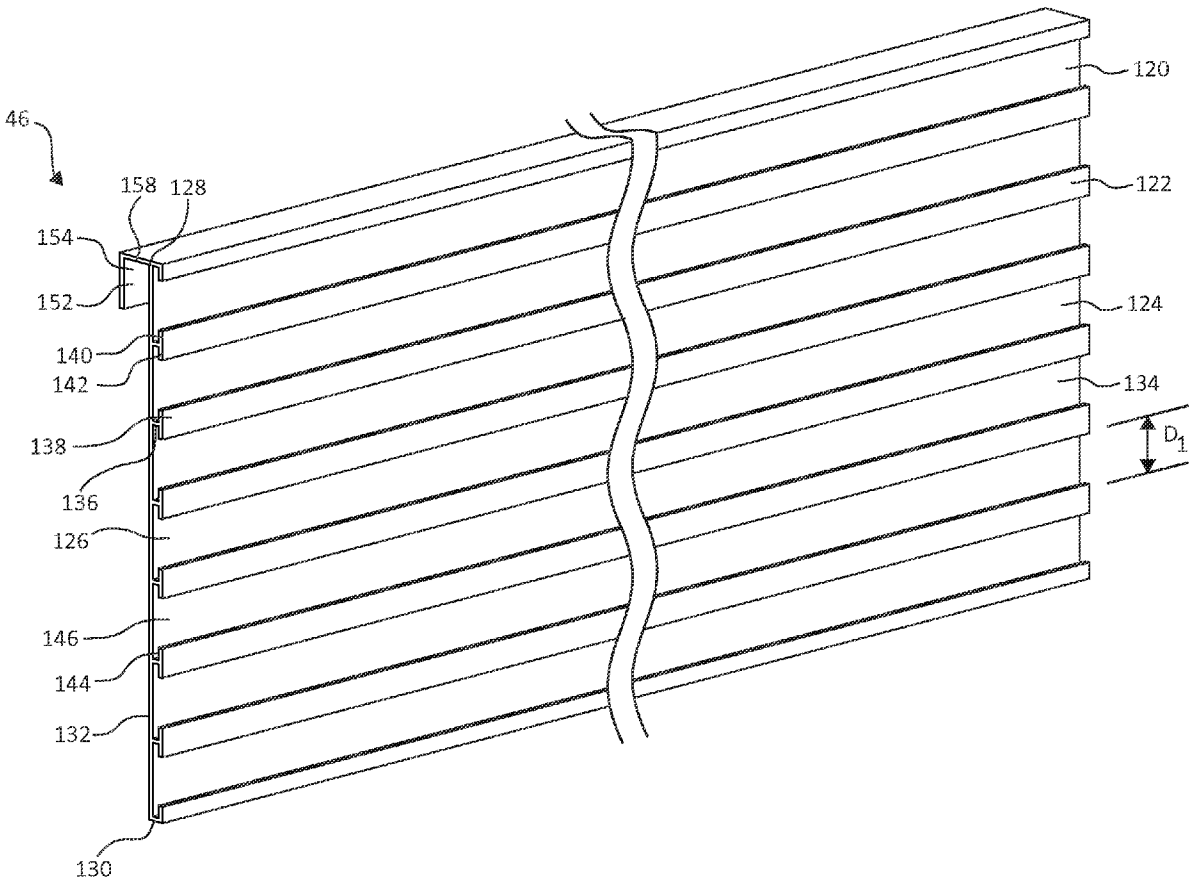
FIG. 5 is a rear perspective view illustration of a first support member of the wall panel system of FIG. 2, according to one embodiment of the present invention.

With reference to FIGS. 2 and 5, in one embodiment, first support member 46 includes a substantially planar panel 120 and a plurality of rails 122. First support member 46 is substantially rectangular or otherwise suitably shaped to extend longitudinally between a first end 124 and a second end 126. Accordingly, first support member 46 defines a top edge 128 and a bottom edge 130 opposite top edge 128, each extending between first end 124 and second end 126, for example, substantially parallel to one another. First support member 46 is substantially planar, in one instance, forming a first or front surface 132 and a second or rear surface 134 opposite front surface 132.

Each rail 122 of the plurality of rails 122 extends rearwardly from rear surface 134 of first support member 46. More particularly, each rail 122 extends longitudinally between and to each of first end 124 and second end 126, in one example, and each rail 122 is vertically spaced from other ones of the plurality of rails 122. In one embodiment, each of the plurality of rails 122 includes a spacing protrusion 136 extending rearwardly from rear surface 134 of substantially planar panel 120, for instance, substantially perpendicularly relative to rear surface 134. Each of the plurality of rails 122 further includes a vertically extending or cross member 138 extending across an end of spacing protrusion 136 opposite rear surface 134. For example, each cross member 138 extends substantially parallel to rear surface 134 and one or both of upwardly and downwardly therefrom.

For example, ones of the plurality of rails 122 between the topmost and bottommost ones of the plurality of rails 122 includes a cross member 138 having a first segment 140 extending upwardly beyond spacing protrusion 136 and a second segment 142 extending downwardly beyond spacing protrusion 136. A topmost one of the plurality of rails 122 is positioned adjacent to and extends substantially coterminously with top edge 128 of substantially planar panel 120. The topmost one of the plurality of rails 122 only includes second segment 142 extending downwardly from spacing protrusion 136 with substantially no portion extending upwardly from spacing protrusion 136, in one example. A bottommost one of the plurality of rails 122 only includes first segment 140 extending upwardly from spacing protrusion 136 with substantially no portion extending downwardly from the corresponding spacing protrusion 136, in one example.

Longitudinally extending channels 144 are defined adjacent spacing protrusion 136 between substantially planar panel 120 and cross member 138, and each of longitudinally extending channels 144 is open opposite spacing protrusion 136 such that pairs of longitudinally extending channels 144 face toward one another. In one example, a pair of longitudinally extending channels 144 that face one another collectively define a reception track 146 for receiving a different mounting member 50, as will be further described below. Each reception track 146 has a substantially identical height, generally indicated as $D_1$ in FIG. 5, such that each reception track 146 can interchangeably receive mounting members 50 having an appropriately sized flange or similar member. In one example, reception tracks 146 are sized and shaped to correspond with various other sign holder members and brackets therefor, for example, as described in U.S. patent application Ser. No. 13/860,386, entitled "Sign Holder Assembly and Associated Method," filed Apr. 10, 2013, which is hereby incorporated by reference.

A spacer flange 150 extends forwardly from front surface 132 of first support member 46, for instance forwardly from top edge 128 of substantially planar panel 120 a distance substantially equal to or greater than a combined thickness of backer board 42 and graphic panel 44. Spacer flange 150 extends longitudinally between and to each of first end 124 and second end 126. First support member 46 further includes a depending or downwardly extending flange 152 extending from an edge of spacer flange 150 opposite substantially planar panel 120 downwardly toward bottom edge 130. In one example, downwardly extending spacer flange 150 extends substantially parallel to or slightly angled toward front surface 132 and defines a reception cavity 154 with bottom opening thereto. In one embodiment, one or more apertures 148 are formed through downwardly extending flange 150 transversely spaced from one another.

In one example, first support member 46 is formed of stacked and glued plastic members, as a single extruded member, or as and injection-molded plastic or similar member. Use of other suitable members and/or materials to form first support member 46 are also contemplated.

Figure 6:
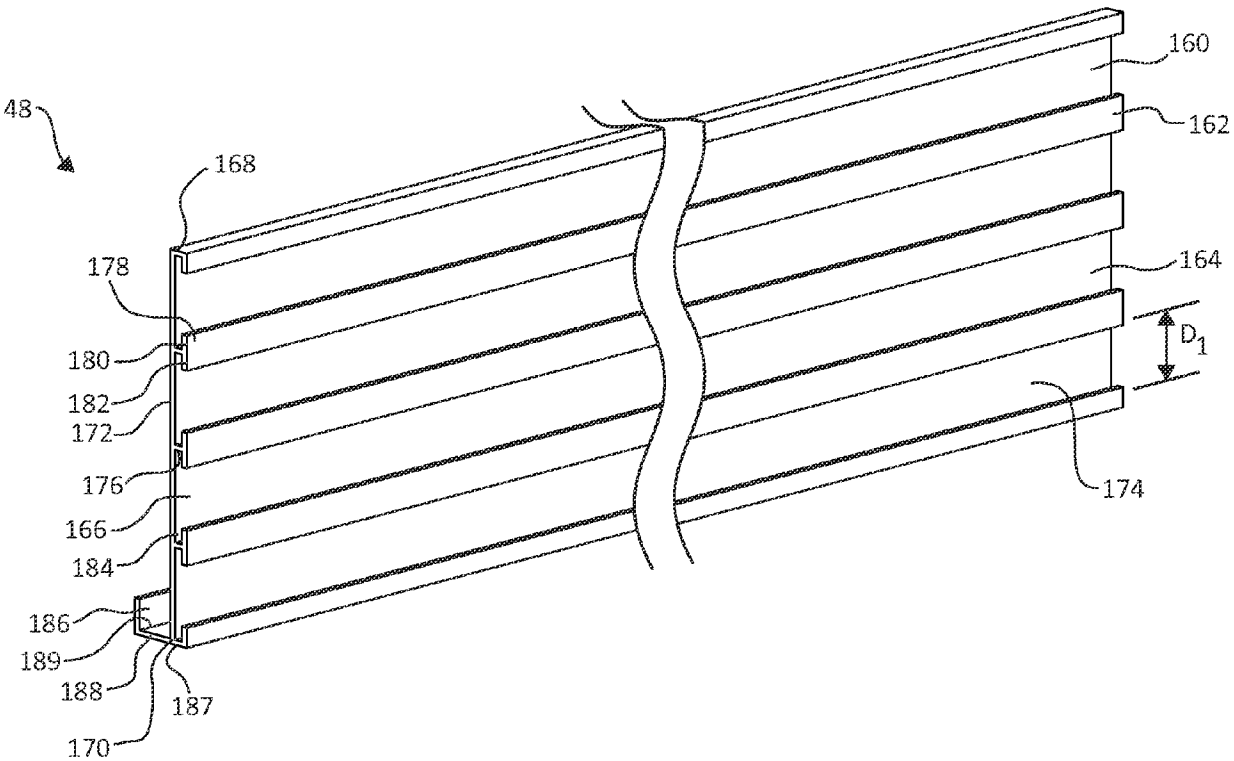
FIG. 6 is a rear perspective view illustration of a second support member of the wall panel system of FIG. 2, according to one embodiment of the present invention.

With additional reference to FIG. 6, in one embodiment, second support member 48 includes a substantially planar panel 160 and a plurality of rails 162. Second support member 48 is substantially rectangular or otherwise suitably shaped to extend longitudinally between a first end 164 and a second end 166. Accordingly, second support member 48 defines a top edge 168 and a bottom edge 170 opposite top edge 168, each extending between first end 164 and second end 166, for example, substantially parallel to one another. Second support member 48 is substantially planar, in one instance, forming a first or front surface 172 and a second or rear surface 174 opposite front surface 172.

Each of the plurality of rails 162 extends rearwardly from rear surface 174 of second support member 48. More particularly, each rail 162 extends longitudinally between and to each of first end 164 and second end 166, in one example, and each rail 162 is vertically spaced from other ones of the plurality of rails 162. In one embodiment, each of the plurality of rails 162 includes a spacing protrusion 176 extending rearwardly from rear surface 174 of support panel 160, for instance, substantially perpendicularly relative to rear surface 174. Each of the plurality of rails 162 further includes a vertically extending or cross member 178 extending across an end of spacing protrusion 176 opposite rear surface 174. For example, each cross member 178 extends substantially parallel to rear surface 174 and one or both of upwardly and downwardly therefrom.

For example, ones of the plurality of rails 162 between the topmost and bottommost ones of the plurality of rails 162 includes a cross member 178 having a first segment 180 extending upwardly beyond spacing protrusion 176 and a second segment 182 extending downwardly beyond spacing protrusion 176. A topmost one of the plurality of rails 162 is positioned adjacent to and extends substantially coterminously with top edge 168 of substantially planar panel 160. The topmost one of the plurality of rails 162 only includes second segment 182 extending downwardly from spacing protrusion 176 with substantially no portion extending upwardly from spacing protrusion 176, in one example. A bottommost one of the plurality of rails 162 only includes first segment 180 extending upwardly from spacing protrusion 176 with substantially no portion extending downwardly from the corresponding spacing protrusion 176, in one example.

Longitudinally extending channels 184 are defined adjacent spacing protrusion 176 between substantially planar panel 160 and cross member 178, and each of longitudinally extending channels 184 is open opposite spacing protrusion 176 such that pairs of longitudinally extending channels 184 face toward one another. In one example, a pair of longitudinally extending channels 184 that face one another collectively define a reception track 186 for receiving a different mounting member 50, as will be further described below. Each reception track 186 has a substantially identical height, generally indicated as $D_1$ in FIG. 6, such that each reception track 186 can interchangeably receive mounting members 50 having an appropriately sized flange or similar member. In one example, reception tracks 186 are sized and shaped to correspond with various other sign holder members and brackets therefor, for example, as described in U.S. patent application Ser. No. 13/860,386, entitled "Sign Holder Assembly and Associated Method," filed Apr. 10, 2013, which is hereby incorporated by reference.

A spacer flange 187 extends forwardly from front surface 172 of second support member 48, for instance, forwardly from bottom edge 170 of substantially planar panel 160 a distance substantially equal to or greater than a combined thickness of backer board 42 and graphic panel 44. Spacer flange 187 extends longitudinally between and to each of first end 164 and second end 166. Second support member 48 further includes an upwardly extending flange 188 extending from an edge of spacer flange 187 opposite substantially planar panel 160 upwardly toward top edge 168. In one example, upwardly extending flange 188 extends substantially parallel to or slightly angled toward front surface 172 and defines a reception cavity 189 being open along a top edge thereof.

In one example, second support member 48 is formed of stacked and glued plastic members, as a single extruded member, or as and injection-molded plastic or similar member. Use of other suitable members and/or materials to form second support member 48 are also contemplated.

Each of first support member 46 and second support member 48 is coupled to elongated supports 14 of retail display 12 (FIG. 1) via one or more connections components or mounting brackets 50, for example two or more mounting brackets 50, illustrated, for example, in FIG. 7. In one embodiment, mounting bracket 50 is bent or otherwise formed from a sheet of metal, such as aluminum or other suitable metal and is similar to the mounting brackets defined in U.S. patent application Ser. No. 13/860,386, entitled "Sign Holder Assembly and Associated Method," filed Apr. 10, 2013, which is hereby incorporated by reference. Mounting bracket 50 defines a front panel 190 (e.g., a backer interface panel or connecting flange), a side panel 192 extending substantially perpendicularly relative to and from one end of front panel 190, and a corner portion 194 extending between and coupling front panel 190 to side panel 192. Each of front panel 190 and side panel 192 is substantially planar. Front panel 190 defines a top edge 196 opposite a bottom edge 198 and extends from corner portion 194 to a free edge 200. Likewise, side panel 192 defines a top edge 202 opposite a bottom edge 204. In one embodiment, top edges 196 and 202 are positioned in a common horizontal plane while corner portion 194 is inset from top edges 196 and 202 toward bottom edges 198 and 204 and from bottom edges 198 and 204 toward top edges 196 and 202 to provide clearance for front panel 190 interaction with reception tracks 146 or 186.

A distance substantially equal to distance $D_1$ is defined between top edge 196 and bottom edge 198 of front panel 190 such that front panel 190 is sized to be received and selectively maintained in any one of reception tracks 146 of first support member 46 and/or any one of reception tracks 186 of second support member 48. Each side panel 192 additionally defines a top protrusion 206, a bottom edge notch 208, a rear cutout 210, and/or an internal notch 212 according to one embodiment of the invention in which mounting bracket 50 is configured to interact with a vertical support such as elongated support 14 having a substantially vertical linear array of reception slots 24 (FIGS. 1 and 2) extending along a front face 18 thereof. More specifically, top protrusion 206 extends upwardly beyond top edge 202 of side panel 192 from a rear edge 213 of side panel 192. Rear cutout 210 extends forwardly from rear edge 213 and defines internal notch 212 extending upwardly from a remainder of rear cutout 210 to be more forwardly positioned than a forwardmost portion of top protrusion 206. Bottom edge notch 208 is formed in a vertical alignment, e.g., along a common vertical line with internal notch 212.

Additionally referring to FIG. 8, during installation, one mounting bracket 50, according to one embodiment, is slid into each of first ends 124 and 164 and second ends 126 and 166 of reception tracks 146 and 186 of first and second support members 46 and 48. The various available reception tracks 146 and 186 allow for increased adjustability in setting a height that wall panel system 10 will be mounted on retail display 12, as different ones of reception tracks 146 and 186 can be selected for use to receive associated mounting brackets 50. Top protrusion 206 of each mounting bracket 50 is rearwardly tilted, moved back through a reception slot 24, and upward into an elongated support 14. Bracket 50 is then rearwardly and downwardly dropped or rotated such that internal notch 212 receives a bottom edge of one of reception slots 24 and bottom edge notch 208 receives a bottom edge of a lower and adjacent one of reception slots 24 of elongated support 14 such that mounting bracket 50 is securely held in place via weight of backer board 42, graphic panel 44, first support member 46, and second support member 48 until intentionally moved upwardly and rotated to move top protrusion 206 out of the corresponding one of reception slots 24.

In one embodiment, mounting brackets 50 are provided in each of a right side orientation and a left side orientation, and one mounting bracket 50 of each orientation is positioned in a selected reception track 146 or 186 of each of first support member 46 and second support member 48 at opposing ends thereof. Mounting brackets 50 are coupled with a corresponding elongated support 14 of retail display 12 as described above such that a remainder of wall panel system 10 is suspended between the two mounting brackets 50. Other configurations and uses are also contemplated.

Once first and second support members 46 and 48 are coupled to retail display 12, backer board 42 and a graphic panel 44 are provided having substantially identical overall dimensions such that graphic panel 44 substantially covers front surface 62 of backer board 42, as illustrated, for example, with reference to FIGS. 1 and 2. In one example, any interior slots 104 of graphic panel 44 each align with a different one of interior slots 74 of backer board 42. In one embodiment, since backer board 42 is configured for repeated use with different graphic panels 44, backer board 42 includes interior slots 74 in standard locations. Graphic panel 44, which is configured for single or relatively few uses, only includes interior slots 104 where needed to receive a pop-off assembly 250 in a particular configuration as will be further described below. As such, graphic panel 44 may have fewer or an equal number of interior slots 74 as compared to interior slots 104 formed in backer board 42. Graphic panel 44 has a sufficient thickness and opaqueness such that portions of graphic panel 44 extending over interior slots 74 in backer board 42 not having corresponding interior slots 104 in graphic panel 44 substantially hide interior slots 74 from view or detection when wall system is viewed from a front side thereof.

The backer board 42 and graphic panel 44 duo is collectively slid into engagement with first support member 46 and second support member 48 as shown with additional reference to FIG. 2. More specifically, top edges 64 and 94 of backer board 42 and graphic panel 44 are together slid into downwardly open reception cavity 154 to be positioned therein between flange 152 and substantially planar panel 120. When so inserted, first support member 46 wraps around a substantial entirety of top edges 64 and 94. In one embodiment, top notches 72 of backer board 42, top apertures 102 of graphic panel 44, and apertures 148 of first support member 46 align with one another and canoe clips 156 (FIG. 2) or other suitable fasteners are inserted therethrough to additionally maintain backer board 42 and graphic panel 44 transversely in place relative to first support member 46.

Bottom edges 66 and 96 of backer board 42 and graphic panel 44 are together slid into upwardly open reception cavity 189 to be positioned therein between flange 186 and substantially planar panel 160, e.g., substantially simultaneously with sliding top edges 64 and 94 in reception cavity 154.

When so inserted, second support member 48 wraps around a substantial entirety of bottom edges 66 and 96. As such, backer board 42 and graphic panel 44 are maintained between reception cavities 154 and 189 of first and second support members 46 and 48. When assembled, backer board 42 provides support to the relative thin graphic panel 44 as the two extend unsupported between first support member 46 and second support member 48. Since backer board 42 provides such support, graphic panels 44 can be quickly printed on a thin paper or similar material and do not require mounting on foam core or other independent supporting member, which reduces the time required to prepare such graphic panels 44 and considerably reduces costs for the one-time use portions of wall panel system 10. In one embodiment, each of backer board 42, graphic panel 44, first support member 46, and second support member 48 have a substantially identical overall lengths such that clean edges are formed at opposing ends of wall panel system 10 as illustrated in FIG. 1. When wall panel system 10 is to be changed, for example, to change graphics 106, etc., backer board 42 and graphic panel 44 are slid out from first and second support members 46 and 48, graphic panel 44 is replaced with a new graphic panel 44 having different graphics 106 and/or different interior slots 104, and the new graphic panel 44 and the same backer board 42 are slid back into engagement with first and second support members 46 and 48. As such, wall panel system 10 is readily customizable and adjustable while providing reuse and recyclability of components. In one embodiment, one or more additional wall panel systems 10 are used in combination on a single retail display 12 as shown, for example, in FIG. 1.

Figure 9:
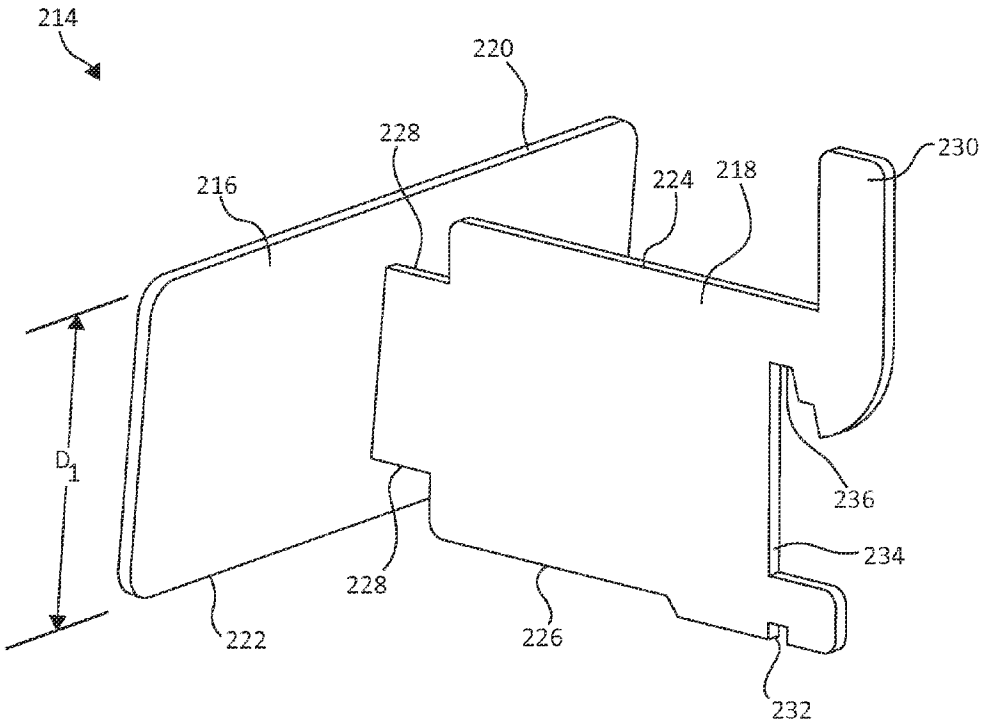
FIG. 9 is a rear perspective view illustration of a mounting bracket, according to one embodiment of the present invention.

FIG. 9 illustrates an alternative or additional mounting bracket 214 for use with a similar wall panel system 10 formed from metal or other suitable material to define a front panel 216 (e.g., a backer interface panel or connecting flange), a rear-extending or side panel 218 extending substantially perpendicularly relative to and from one end of front panel 216. Each of front panel 216 and side panel 218 is substantially planar, and side panel 218 rearwardly extends from front panel 216 substantially centered on front panel 216 in a left-to-right or transverse direction. Front panel 216 defines a top edge 220 opposite a bottom edge 222 spaced apart a distance $D_1$ substantially identical to distance $D_1$ above such that front panel 216 is sized to be received and selectively maintained in any one of reception tracks 146 of first support member 46 and/or any one of reception tracks 186 of second support member 48. Side panel 218 defines a top edge 224 opposite a bottom edge 226. In one embodiment, top edges 220 and 224 are positioned in a common horizontal plane while top and bottom cutouts 228 are formed in side panel 218 immediately adjacent front panel 216 to provide clearance for front panel 216 interaction with reception tracks 146 or 186.

Side panel 218 additionally defines a top protrusion 230, a bottom edge notch 232, a rear cutout 234, and/or an internal notch 236 similar to top protrusion 206, bottom edge notch 208, rear cutout 210, and internal notch 212 of mounting bracket 50 such that mounting brackets 50 and 214 interface and hang from retail display 12 in a substantially identical manner. However, since side panel 218 is centered relative to front panel 216, mounting bracket 214 is particularly well suited for use where the supported assembly extends across and to either side of a corresponding elongated support 14.

Figure 10:
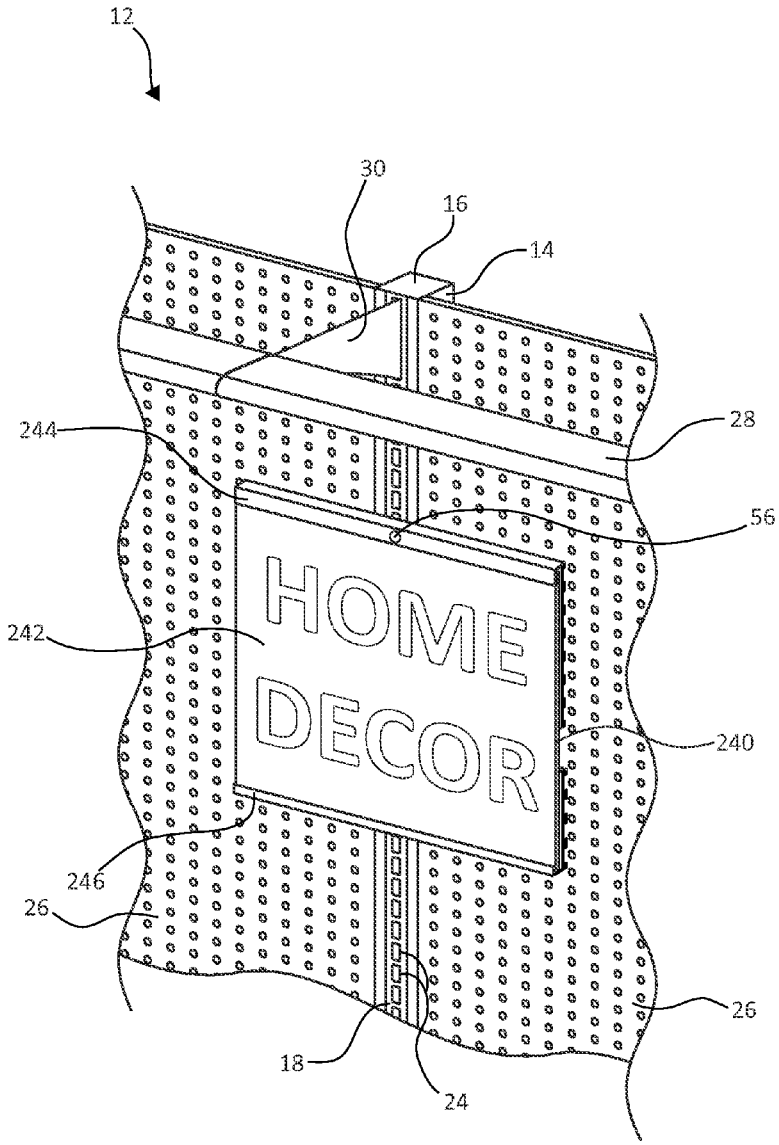
FIG. 10 is a front perspective view illustration of the retail display and a wall panel system using the mounting bracket of FIG. 9, according to one embodiment of the present invention.

For example, referring to FIG. 10, a mounting bracket 214 (FIG. 9) is used to support backer board 240, graphic panel 242, first support member 244, and second support member 246 extending across elongated support 14, but not to another elongated support 14 such that only one bracket 214 is used in combination with each of first support member 244 and second member 246 to hang each from retail display 12. Notably, each of backer board 240, graphic panel 242, first support member 244, and second support member 246 is substantially identical to a respective one of backer board 42, graphic panel 44, first support member 46, and second support member 48 other than dimensions and/or numbers of rails of first and second support members 244 and 246, etc. as will be apparent to those of skill in the art upon reading this application. In another embodiment (not shown), bracket 214 can be used between two opposing brackets 50 to support wall panel system extending between a first and third elongated supports and across an intermediate or second elongated support.

Figure 13:
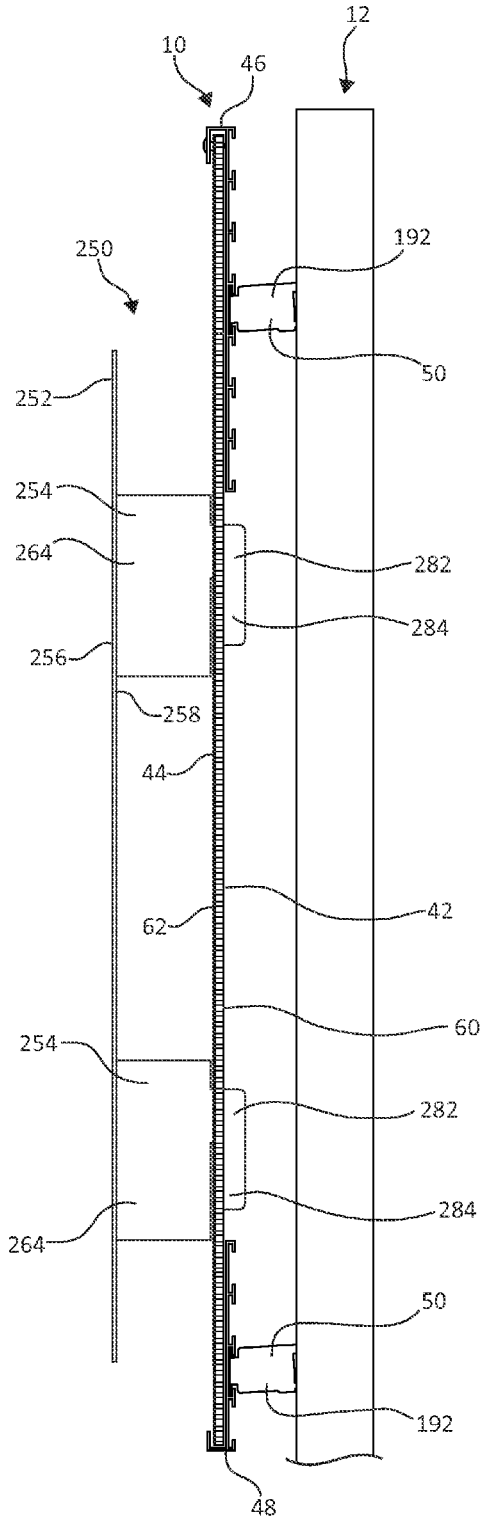
FIG. 13 is partial side view illustration of the retail display and the wall panel system of FIG. 1, according to one embodiment of the present invention.

In one example, wall panel system 10 additionally includes a pop-off panel assembly 250 as illustrated in FIG. 1. Pop-off panel assembly 150 provides an additional surface for presenting information or graphics to consumers that is spaced in front of front surface 92 of graphic panel 44 to present a three-dimensional overall appearance adding to the aesthetic appeal and overall impact of the overall display. Additionally referring to the rear view of pop-off panel assembly 250 of FIG. 11 and the side view illustration of retail display 12 and wall panel assembly 10 including pop-off panel assembly 250 of FIG. 13, pop-off panel 250 includes a front panel 252 and a plurality of pop-of boxes 254 (e.g., spacing members) extending rearwardly therefrom and being configured to selectively couple with a remainder of wall panel system 10. Front panel 252 is formed of a suitable material, e.g., paper-based display board or foam core board, having sufficient rigidity and dimensional stability to maintain its substantial planarity between and beyond the supporting pop-off boxes 254. Front panel 252 defines a front surface 256 and an opposing rear surface 258 where front surface 256 includes graphics 260 including text and/or other indicia as desired to enhance retail display 12.

Figure 11:
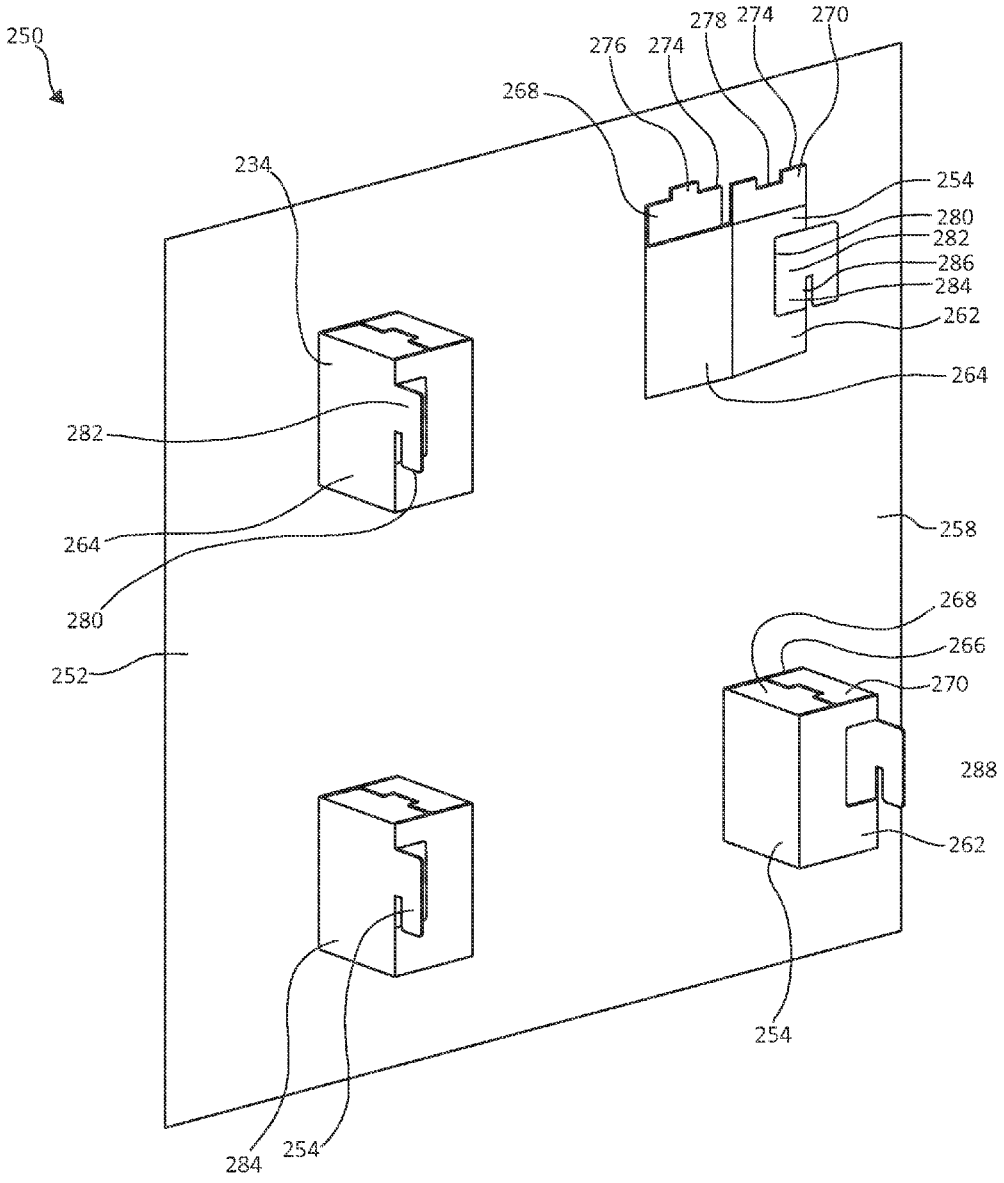
FIG. 11 is a rear perspective view of a pop-off panel assembly of the wall panel system of FIG. 1, according to one embodiment of the present invention.
Figure 12:
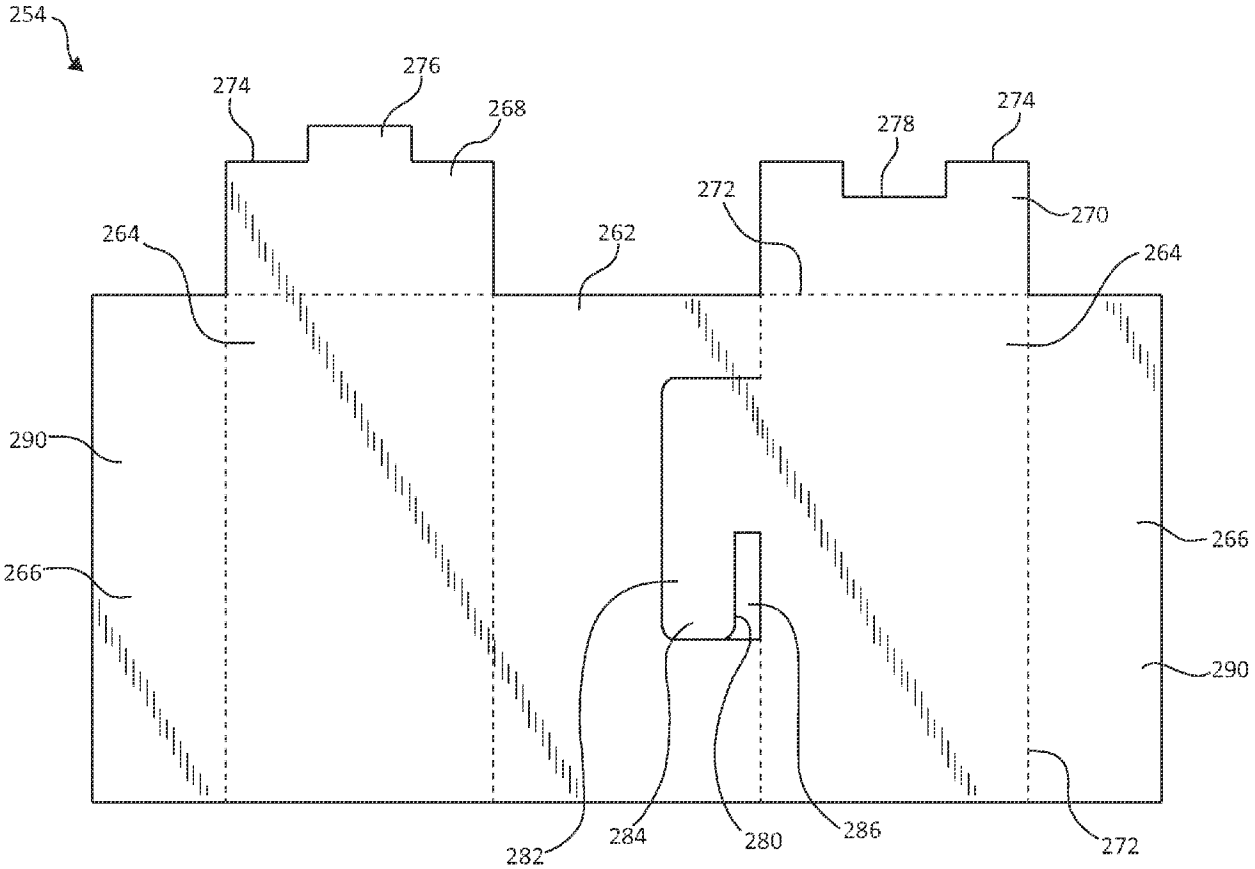
FIG. 12 is a rear view of an unfolded pop-off box of the pop-off panel assembly of FIG. 11, according to one embodiment of the present invention.

Each pop-off box 254 is formed of a single planar piece of paperboard, cardboard, or other fairly rigid yet foldable material such that pop-off box 254 is readily movable between a flattened or storage position (see, e.g., the upper right hand pop-off box 254 in FIG. 11) and an extended or use position (see, e.g., all other pop-off boxes 254 in FIG. 11). More specifically, FIG. 12 illustrates flat pop-off box 254 before folding for use with front panel 252. Pop-off box 254 defines a rear wall 262, opposing sidewalls 264, opposing front flanges 266, a first intermediate flange 268, and a second intermediate flange 270 each separated from one another by fold lines 272. Rear wall 262 is substantially rectangular and is flanked on either side by one of opposing sidewalls 264 extending outwardly away therefrom to a corresponding one of opposing front flanges 266.

In one example, intermediate flanges 268 and 270 each extend from a top edge of a different one of opposing sidewalls 264 upwardly away therefrom to a free edge 274. One of intermediate flanges 268 and 270 defines a tab 276 extending outwardly from free edge 274 further away from the corresponding opposing sidewall 264 than free edge 274. The other of intermediate flanges 268 and 270 defines a notch 278 corresponding in width to tab 276 and extending downwardly toward the corresponding sidewall 264 from the corresponding free edge 274. Intermediate flanges 268 and 270 are configured to selectively interlock with one another as will be further described below.

A substantially planar hook 282 is formed by one of opposing sidewalls 264, e.g., by extending into a portion of pop-off box 254 that would otherwise be part of rear wall 262. Substantially planar hook 282, more particularly, is defined by cut line 280 forming substantially planar hook 282 in a substantial L-shape extending first transversely from the one of the opposing sidewalls 264 beyond fold line 272 between the one of the opposite sidewalls 264 and front wall 262 and then downwardly as a hook extension 284 therefrom. In one example, cut line 280 forms an aperture 286 between hook extension 284 and a frontmost boundary of the one of opposite sidewalls 264.

During use, pop-off box 254 is folded along fold lines 272 such that external surfaces 290 of the opposing front flanges 266 are adhered or otherwise suitably secured to rear surface 258 of front panel 252 of pop-off panel assembly 250. In one embodiment, pop-off box 254 is folded during use so opposing sidewalls 264 extend substantially perpendicularly and rearwardly from rear surface 258 and front flanges 266 and rear wall 262 extends substantially parallel to rear surface 258. In one example, to maintain pop-off box 254 in a generally rectangular shape as described above, intermediate flanges 268 and 270 are selectively coupled with one another by sliding tab 276 into corresponding notch 278 or via other suitable features on each of intermediate flanges 268. While described as extending above each of opposing sidewalls 264, in other embodiments, intermediate flanges 268 extends from rear wall 262 and front flanges 266 and/or below corresponding portions of pop-off box 254 as will be apparent to those of skill in the art upon reading this application.

During storage and/or transport of pop-off panel assembly 250, each pop-off box 254 can be folded into a substantially flat position as generally illustrated in the upper right hand corner of FIG. 11. During use of pop-off panel assembly 250, pop-off boxes 254 are folded outwardly and intermediate flanges 268 and 270 coupled to one another to maintain each pop-off box 254 with a substantially rectangular cross-sectional shape other than planar hook 282. The number of pop-off boxes 254 used will vary depending upon the size of front panel 254 and the location of pop-off boxes 254 relative to each other is determined such that planar hooks 282 each align with interior slots 74 and 104 of backer board 42 and graphics panel 44. Accordingly, during use pop-off panel assembly 250 is hung by placing each hook extension 284 of each planar hook 282 in an aligned one of interior slots 74 and 104. In this manner, portions of backer board 42 and graphic panel 44 are maintained between hook extension 284 and rear wall 262 of each pop-off box 254 as illustrated with additional reference to FIG. 12. In one example, distances between interior slots 74 and 104 of a single backer board 42 and graphic panel 44 are the same as a distance between a last column 112 of interior slots 74 and 104 of one backer board 42 and graphic panel pair 44 and a first column 11 of interior slots 74 and 104 of an immediately adjacent backer board 42 and graphic panel pair 44 as shown in FIG. 1 such that pop-off panel assembly 250 straddles between the two assemblies, but could similarly be used on a single assembly (i.e., a single backer board 42 and graphic panel 44 pair) as will be apparent to those of skill in the art.

The wall panel system 10 as described above and as will be apparent to those of skill in the art upon reading this application provides a customizable, readily removable and replaceable, and environmentally conscious system that provides for increased aesthetics and overall clean appearance of a retail display 12 while, in some instances, additionally providing potential consumers with information related to the retail store and/or products being offered for sale therein.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A wall panel system for coupling to a retail display, the wall panel system comprising:

a first support member including a first substantially planar panel and a first reception cavity extending along a top edge and a front face of the first substantially planar panel;

a second support member formed separately from the first support member, the second support member including a second substantially planar panel and a second reception cavity extending along a bottom edge of a front face of the second substantially planar panel;

a plurality of mounting brackets configured to each be selectively coupled with the retail display, wherein at least a first mounting bracket of the plurality of mounting brackets couples the first support member to the retail display, and at least a second mounting bracket of the plurality of mounting brackets couples the second support member to the retail display below the first support member;

a backer board defining a front surface, a top edge, and a bottom edge, the backer board being substantially planar, wherein the backer board defines a first plurality of elongated slots formed in an interior of the backer board; and a pop-off assembly including;

a front panel defining a rear, substantially planar surface, and a pop-off box coupled to the rear, substantially planar surface of the front panel and including a hook extending rearwardly from a remainder of the pop-off box;

wherein:

the hook extends through the first plurality of elongated slots to couple the pop off assembly to the backer board, the pop-off box maintains the front panel of the pop-off assembly spaced from the backer board, the top edge of the backer board is slidably received in the first reception cavity of the first support member, and the bottom edge of the backer board is slidably received in the second reception cavity of the second support member.

2. The wall panel system of claim 1, wherein:

the first support member defines a rear face of the first substantially planar panel and at least one first rear reception track along the rear face of the first substantially planar panel, the second support member defines a rear face of the second substantially planar panel and at least one second rear reception track along the rear face of the second substantially planar panel, the first mounting bracket is slidably received in the at least one first rear reception track, and the second mounting bracket is slidably received in the at least one second rear reception track.

3. The wall panel system of claim 2, wherein the first mounting bracket and the second mounting bracket are interchangeable with one another and each configured to be received in either one of the at least one first rear reception track and the at least one second rear reception track.

4. The wall panel system of claim 1, wherein the plurality of mounting brackets are formed separately from each of the first support member and the second support member.

5. The wall panel system of claim 1, further comprising a graphic panel defining a rear surface, a top edge, and a bottom edge, wherein:

the rear surface of the graphic panel faces the front surface of the backer board, the top edge of the graphic panel is slidably received in the first reception cavity of the first support member, the bottom edge of the graphic panel is received in the second reception cavity of the second support member, the backer board is substantially more rigid than the graphic panel and independently supports the graphic panel between the first support member and the second support member.

6. The wall panel system of claim 5, wherein the backer board is configured for reuse with other graphic panels.

7. The wall panel system of claim 1, wherein the first support member includes a forwardly extending flange extending from the top edge of the first substantially planar panel and a depending flange extending from an edge of the forwardly extending flange opposite the first substantially planar panel to define the first reception cavity, and wherein the forwardly extending flange and the depending flange are the only portions of the first support member extending in front of the front face of the first substantially planar panel.

8. The wall panel system of claim 1, wherein:

each mounting bracket of the plurality of mounting brackets includes a front panel and a rear panel extending rearwardly from the front panel, the first support member includes at least one first rear reception track along a rear face of the first substantially planar panel, the front panel of the first mounting bracket of the plurality of mounting brackets is slidably received in the at least one first rear reception track to couple the first support member to the first mounting bracket, and the rear panel includes a retail display coupling feature configured to selectively couple with an elongated support of the retail display.

9. The wall panel system of claim 8, wherein the rear panel extends substantially perpendicularly to the front panel, and each mounting bracket of the plurality of mounting brackets is formed as a single piece.

10. The wall panel system of claim 1, further comprising a graphic panel defining a rear surface, a top edge, and a bottom edge, wherein:

the rear surface of the graphic panel faces the front surface of the backer board, the top edge of the graphic panel is slidably received in the first reception cavity of the first support member, the bottom edge of the graphic panel is received in the second reception cavity of the second support member, the first support member, the second support member, the backer board, and the graphic panel all have substantially identical overall lengths.

11. The wall panel system of claim 1, further comprising a graphic panel defining a rear surface, a top edge, and a bottom edge, wherein:

the rear surface of the graphic panel faces the front surface of the backer board, the top edge of the graphic panel is slidably received in the first reception cavity of the first support member, the bottom edge of the graphic panel is slidably received in the second reception cavity of the second support member, the graphic panel includes a second plurality of elongated slots formed in an interior of the graphic panel, and each of the second plurality of elongated slots aligns with a different elongated slot of the first plurality of elongated slots, and the pop-off box maintains the front panel of the pop-off assembly spaced from the graphic panel.

12. The wall panel system of claim 11, wherein:

the first plurality of elongated slots includes more elongated slots than the second plurality of elongated slots, and the graphic panel extends over and covers an entirety of at least one of the first plurality of elongated slots.

13. The wall panel system of claim 1, wherein:

the first support member includes a downwardly extending flange spaced in front of the front face of the first substantially planar panel and at least partially defining the first reception cavity, the downwardly extending flange defines a plurality of apertures, and the wall panel system includes a plurality of fasteners each extending through one of the plurality of apertures and the backer board to secure the backer board to the first support member.

14. The wall panel system of claim 1, wherein:

the first support member wraps around a substantial entirety of the top edge of the backer board, and the second support member wraps around a substantial entirety of the bottom edge of the backer board.

15. A wall panel system for coupling to a retail display, the wall panel system comprising:

a first support member including a first substantially planar panel and a first reception cavity extending along a top edge and a front face of the first substantially planar panel;

a second support member formed separately from the first support member, the second support member including a second substantially planar panel and a second reception cavity extending along a bottom edge of a front face of the second substantially planar panel;

a plurality of mounting brackets configured to each be selectively coupled with the retail display, wherein:

at least a first mounting bracket of the plurality of mounting brackets couples the first support member to the retail display, and at least a second mounting bracket of the plurality of mounting brackets couples the second support member to the retail display below the first support member;

a backer board defining a front surface, a top edge, and a bottom edge, the backer board being substantially planar, wherein the backer board defines a first plurality of elongated slots formed in an interior of the backer board;

a graphic panel defining a rear surface, a top edge, and a bottom edge, wherein:

the rear surface of the graphic panel faces the front surface of the backer board, the top edge of the backer board and the top edge of the graphic panel are each slidably received in the first reception cavity of the first support member, and the bottom edge of the backer board and the bottom edge of the graphic panel are each slidably received in the second reception cavity of the second support member, the graphic panel includes a second plurality of elongated slots formed in an interior of the graphic panel, and each of the second plurality of elongated slots aligns with a different elongated slot of the first plurality of elongated slots; and a pop-off assembly including:

a front panel defining a rear, substantially planar surface, and a pop-off box coupled to the rear, substantially planar surface of the front panel and including a hook extending rearwardly from a remainder of the pop-off box;

wherein:

the hook extends through one of the first plurality of elongated slots and one of the second plurality of elongated slots to couple the pop-off assembly to the backer board and the graphic panel, and the pop-off box maintains the front panel of the pop-off assembly spaced from the graphic panel.

16. The wall panel system of claim 15, wherein the front panel has smaller dimensions than the backer board.

17. The wall panel system of claim 15, wherein the pop-off box is collapsible from a use position to a substantially flattened storage position.

18. A method of installing a wall panel system on a retail display, the method comprising:

sliding at least a first mounting bracket into a rear reception track of a first support member, the first support member defining a substantially planar panel and a first front reception cavity open along a bottom edge of the first front reception cavity, wherein sliding at least the first mounting bracket into the rear reception track of the first support member includes selecting the rear reception track from a plurality of rear reception tracks defined by the first support member;

selectively engaging the retail display with the first mounting bracket to hang the first support member from the retail display;

sliding at least a second mounting bracket into a rear reception track of a second support member, the second support member defining a substantially planar panel and a second front reception cavity open along a top edge of the second front reception cavity;

selectively engaging the retail display with the second mounting bracket to hang the second support member from the retail display;

positioning a graphic panel over a backer board, wherein the graphic panel and the backer board have substantially identical outer dimensions, and the backer board supports the graphic panel; and simultaneously sliding top edges of the graphic panel and the backer board into the first front reception cavity and sliding bottom edges of the graphic panel and the backer board into the second front reception cavity.

19. The method of claim 18, wherein the graphic panel is a first graphic panel, and the method further comprises:

sliding the first graphic panel and the backer board out of the first front reception cavity and the second front reception cavity;

discarding the first graphic panel;

positioning a second graphic panel over the backer board; and simultaneously sliding top edges of the second graphic panel and the backer board into the first front reception cavity and sliding bottom edges of the graphic panel and the backer board into the second front reception cavity.

20. The method of claim 18, further comprising:

sliding a third mounting bracket into an opposing end of the rear reception track of the first support member; and selectively engaging the retail display with the third mounting bracket to hang the first support member from the retail display between the first mounting bracket and the third mounting bracket.

21. The method of claim 18, wherein selectively engaging the retail display with the second mounting bracket to hang the second support member from the retail display includes placing a protrusion of the second mounting bracket through an elongated slot formed in a vertical support of the retail display.

22. The method of claim 21, wherein selectively engaging the retail display with the second mounting bracket to hang the second support member from the retail display includes deciding which one of a plurality of elongated slots the protrusion should be placed in based on an overall height of the backer board and a relative position of the first support member on the retail display.

23. A method of installing a wall panel system on a retail display, the method comprising:

sliding at least a first mounting bracket into a rear reception track of a first support member, the first support member defining a substantially planar panel and a first front reception cavity open along a bottom edge of the first front reception cavity;

selectively engaging the retail display with the first mounting bracket to hang the first support member from the retail display;

sliding at least a second mounting bracket into a rear reception track of a second support member, the second support member defining a substantially planar panel and a second front reception cavity open along a top edge of the second front reception cavity;

selectively engaging the retail display with the second mounting bracket to hang the second support member from the retail display;

positioning a graphic panel over a backer board, wherein the graphic panel and the backer board have substantially identical outer dimensions, and the backer board supports the graphic panel;

simultaneously sliding top edges of the graphic panel and the backer board into the first front reception cavity and sliding bottom edges of the graphic panel and the backer board into the second front reception cavity;

transitioning a pop-off box from a flattened position to an extended position, wherein the pop-off box is secured to and extends rearwardly from a rear surface of a front, substantially planar panel formed separately from the pop-off box; and inserting rearwardly extending hooks of the pop-off box through aligned elongated slots formed through interiors of each of the graphic panel and the backer board to hang the front, substantially planar panel from the graphic panel and the backer board such that the front, substantially planar panel is maintained spaced in front of the graphic panel.

24. The method of claim 23, wherein after inserting rearwardly extending hooks of the pop-off box through aligned elongated slots to hang the front, substantially planar panel, the front, substantially planar panel extends beyond at least one outer edge of the graphic panel and the backer board.

* * * * *